United States Patent [19]

Reinke

[11] 4,363,281

[45] Dec. 14, 1982

[54] SEWING-MACHINE SYSTEM FOR CONTINUOUSLY MONITORING WORKPIECE THICKNESS

[75] Inventor: Kurt Reinke, Bielefeld, Fed. Rep. of Germany

[73] Assignee: Dürkoppwerke GmbH, Bielefeld, Fed. Rep. of Germany

[21] Appl. No.: 198,148

[22] Filed: Oct. 17, 1980

[30] Foreign Application Priority Data

Oct. 18, 1979 [DE] Fed. Rep. of Germany ..... 2942166

[51] Int. Cl.[3] ..... D05B 19/00

[52] U.S. Cl. ..... 112/121.11; 112/272

[58] Field of Search ..... 112/2, 121.11, 121.12, 112/121.26, 272, 305, 312, 313, 235, 303, 154

[56] References Cited

U.S. PATENT DOCUMENTS

| | | | |
|---|---|---|---|
| 3,082,716 | 3/1963 | Nicolay | 112/2 |
| 3,194,195 | 7/1965 | Kremer et al. | 112/235 X |
| 3,970,017 | 7/1976 | Babson et al. | 112/121.12 |

*Primary Examiner*—Peter P. Nerbun

*Attorney, Agent, or Firm*—Karl F. Ross

[57] ABSTRACT

An attachment for a sewing machine comprises a looper bar positionable for horizontal oscillation underneath a vertically reciprocating needle, at a level determined by a workpiece feeler engaging the upper surface of a fabric being sewn, which is swingably carried on the stem of a presser foot resting on the workpiece while the latter is intermittently advanced by a bottom feeder periodically rising from a slot in a stitch plate and a reciprocable gripper foot synchronized therewith to act as a top feeder. A first sensor detects a rise in the presser foot, to an extent indicating the presence of resilient padding between an upper and a lower fabric layer, to activate the looper bar; a second sensor temporarily deactivates the first sensor whenever the bottom feeder projects above the stitch plate. The first sensor can also be used to change the stroke of the top feeder relatively to that of the bottom feeder whenever the workpiece thickness is found to surpass another threshold indicative of the need for providing one fabric layer with an excess of material compared with the other layer.

6 Claims, 4 Drawing Figures

SEWING-MACHINE SYSTEM FOR CONTINUOUSLY MONITORING WORKPIECE THICKNESS

FIELD OF THE INVENTION

My present invention relates to an attachment for a sewing machine, of the type equipped with a looper bar horizontally swingable above a workpiece-supporting surface below a vertically reciprocating needle for producing a series of loose stitches when a piece of resiliently compressible material, such as a foam-rubber pad or wadding to be sewn into a garment in the region of an armhole, is temporarily compacted to less than its normal thickness while passing under the spring-loaded presser foot of the machine.

BACKGROUND OF THE INVENTION

Such an attachment has been disclosed in U.S. Pat. No. 3,082,716 in the name of Karl Nicolay, issued 26 Mar. 1963 to the assignee of my present invention, which also describes a mechanism for manually coupling the looper bar to the machine drive whenever such a padded workpiece comes to lie under the presser foot. As further shown in that patent, the looper bar is fastened to a block which is vertically slidable and axially swingable on the stem of the presser foot, the vertical position of that block and thus of the looper bar being controlled by a workpiece feeler via a yieldable linkage which allows the pressure foot to be lifted off the workpiece without rupturing the loose stitches enveloping the looper bar. The prior patent also shows a reciprocating bottom feeder overlain by a top feeder comprising a serrated gripper foot which is straddled by prongs of the presser foot above a work-supporting plate.

It has already been proposed to utilize a sensor for detecting the presence of an elastic shoulder pad to be stitched, characterized by a predetermined minimum thickness, as a means for automatically actuating a looper bar of this character. A problem heretofore encountered with such an arrangement lies in the difficulty of obtaining an accurate measure of the thickness of the compacted workpiece underneath the presser foot since the rise and fall of the bottom feeder, which periodically projects above the workpiece-supporting surface of a slotted stitch plate, changes the position of the presser foot which therefore may improperly signal the presence of padding when there is in fact only a minor change in fabric thickness.

OBJECTS OF THE INVENTION

The general object of my present invention, therefore, is to provide means for more accurately detecting a predetermined minimum increase in workpiece thickness for the purpose of cutting in a looper bar to enable the formation of loose stitches enabling re-expansion of a compressed resilient workpiece portion.

A related object is to provide similar means for the accurate detection of a thickness threshold calling for different rates of advance of an upper and a lower workpiece layer in order that one of these layers have an excess of material over the other layer after they have been stitched together, as required for instance in the region of the armpit since the sleeve is generally cut somewhat wider than the corresponding cutout in the body of the garment.

SUMMARY OF THE INVENTION

In accordance with my present invention, the presser foot of a sewing machine of the general type described in prior U.S. Pat. No. 3,082,716 coacts with position-sensing means continuously monitoring the thickness of a workpiece entrained by an intermittently operating bottom feeder, coupling means controlled thereby for connecting an associated looper bar with the machine drive in the presence of a workpiece portion exceeding a predetermined minimum thickness as determined by the position of the presser foot above the workpiece-supporting surface of a stitch plate, and inhibiting means responsive to the machine drive for deactivating the position-sensing means whenever the bottom feeder projects above the supporting surface.

Pursuant to a more particular feature of my invention, the position-sensing means comprises a first motion detector juxtaposed with the stem of the presser foot while the inhibiting means comprises a second motion detector coacting with a member entrained by the machine drive. These motion detectors may be contactless electromagnetic proximity sensors of a type known per se, e.g. from U.S. Pat. No. 4,193,023.

The driven member coacting with the second motion detector or sensor advantageously is a link coupled with the needle bar whose up-and-down movements are synchronized with those of the aforementioned feeder. With needles moving along a fixed vertical line, as is the case in many machines including the one more particulary described hereinafter, the needle is elevated when the feeder rises above the supporting surface. In other instances the needle also swings in the plane of workpiece advance and thus forms part of a top feeder whose low point coincides with the needle bar approaching either its top or its bottom position, depending on the type of sewing machine involved.

the machine may also include a top feeder in the form of a reciprocable gripper foot, similar to that shown in the earlier Nicolay patent, synchronized with the underlying bottom feeder but provided with means for varying the relative stroke lengths of the two feeders to enable a differentiated advance of upper and lower workpiece layers for the purpose referred to above. A mechanism for adjusting the relative stroke lengths of such intermittent feeders is known, for example, from German Pat. No. 975,242 (1961). The position-sensing means according to my invention can also be advantageously used for actuating such a mechanism in response to a thickness threshold distinct from the one used for operatively connecting the looper bar with the machine drive, or any ancillary equipment.

BRIEF DESCRIPTION OF THE DRAWING

The present invention will now be described in detail with reference to the accompanying drawing in which.

SPECIFIC DESCRIPTION

Figure 1:
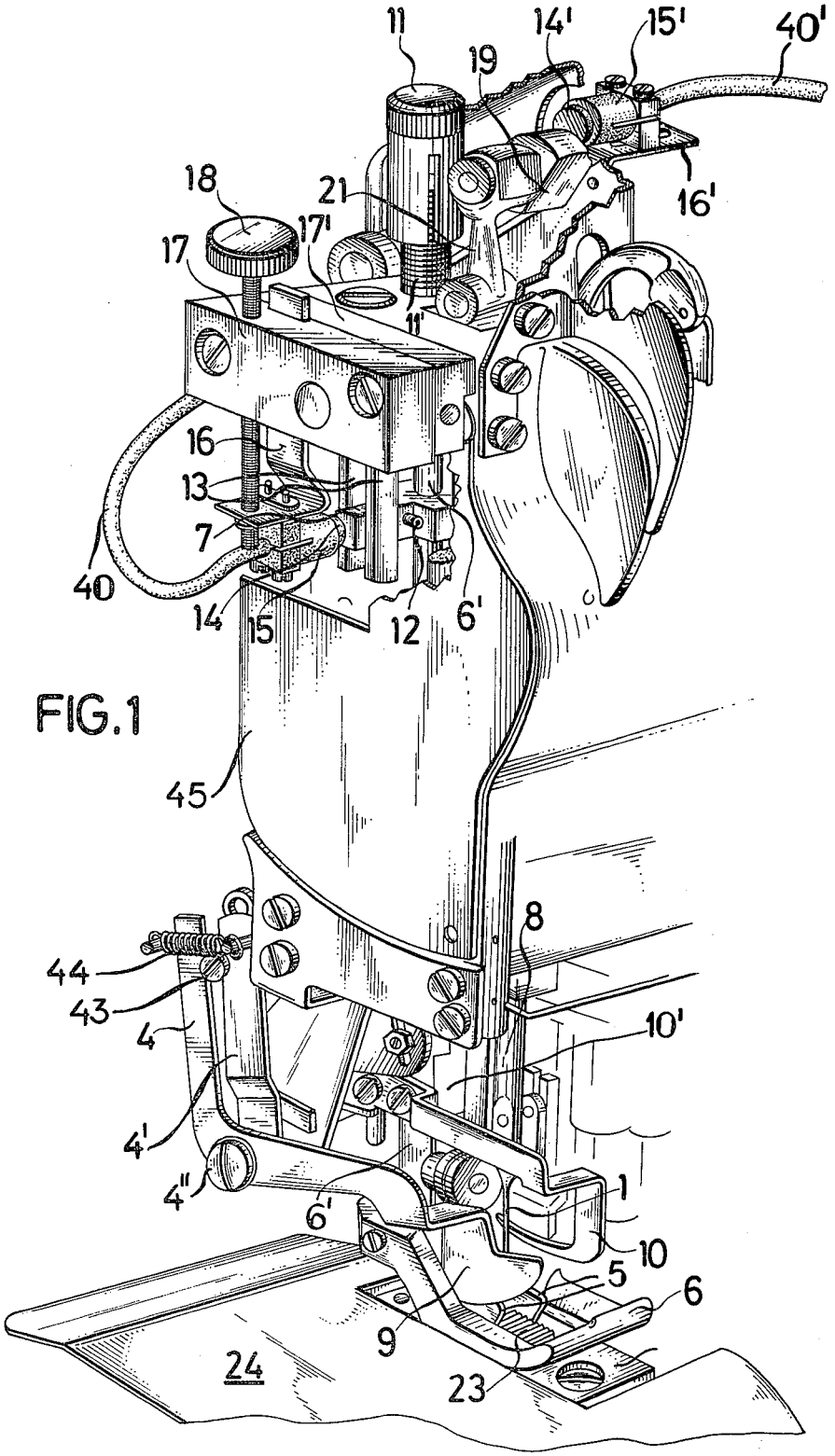
FIG. 1 is a fragmentary perspective end view of the head of a sewing machine equipped with an attachment embodying my invention.

As shown in FIG. 1, a sewing machine with a bed or work table 24 and a frame 45 (which is partly broken away in FIG. 1 to expose some of the mechanism in its interior) has a slotted stitch plate 46 inserted in its bed, plate 46 being intermittently penetrated by a conventional feed dog 23. A two-pronged presser foot 6 has a stem 6' which is vertically guided in frame 45 and extends into a cap 11 containing a coil spring which urges the foot 6 onto a workpiece being sewn when the foot is lowered onto the workpiece in the usual manner. The pressure of this spring can be adjusted by rotating the cap 11 on a tubular bolt 11' onto which it is threaded.

The prongs of pressure foot 6 straddle two similar prongs of a gripper foot 5 which serves as a top feeder coacting with the bottom feeder constituted by dog 23. The gripper foot 5, which is similar to those shown in the above-identified U.S. Pat. No. 3,082,716 and German Pat. No. 975,242, is suspended from frame 45 in a manner not further illustrated so as to be reciprocable by the machine drive in the same vertical plane as dog 23 synchronized therewith. A feeler 9 contacts the workpiece at a location close to feet 5 and 6, this feeler forming an extension of a bell-crank lever 4 whose structure is the same as that of a corresponding lever in Nicolay U.S. Pat. No. 3,082,716 and which coacts with an arm 4' swingable about its pivot 4'' to clamp a pin 43 between itself and that arm under the tension of a spring 44. Pin 43 is part of a linkage controlling the position of a looper bar 10 fastened to a block 10' which is vertically slidable on the stem 6' and is horizontally swingable about that stem, all as described in the Nicolay patent.

The stem 6' of presser foot 6 carries a lug 7, clamped to it by a screw 12, which is vertically guided between two stationary rails 13 to keep the presser foot pointed in the direction of workpiece motion. Lug 7 is closely confronted by a proximity sensor 14 which is gripped in a split sleeve 15 supported by a leaf spring 16. The latter is clamped in turn between two jaws 17 and 17' bolted to frame 45; a screw 18 threaded into jaw 17 engages the sensor-supporting extremity of spring 16 to enable a vertical adjustment of the sensor position upon a loosening of the two jaws.

A similar sensor 14' is gripped by a split sleeve 15' and is carried on a mounting plate 16' which can also be vertically adjusted, by means not further illustrated, relatively to machine frame 45. The two sensors 14 and 14' are connected by respective cables 40 and 40' to a control unit 30 (FIGS. 2 and 4) which will be more fully described hereafter.

Sensor 14' confronts a lever 19 which is driven by the nonillustrated main shaft of the sewing machine to oscillate a crank 21 linked with a needle bar 8 for vertically reciprocating same in the usual manner. When a needle 1 carried by bar 8 moves toward its top position, at an instant coinciding with a rise of feed dog 23 above the surface of stitch plate 46, lever 19 approaches the sensor 14' which thereupon emits a signal inhibiting the sensor 14 for a time sufficient to let the dog 23 descend below the plate surface. Sensor 14, when not so inhibited, detects a rise of lug 7 above its normal operating level to emit a command for the actuation of looper bar 10 which then starts oscillating underneath the elevated needle 1 for the formation of loose stitches, as described in the Nicolay patent, until such actuation is countermanded by the same sensor in response to a descent of lug 7. This sensor is also deactivated by a nonillustrated switch when the operator lifts presser foot 6 along with gripper foot 5 off the workpiece.

Figure 2:
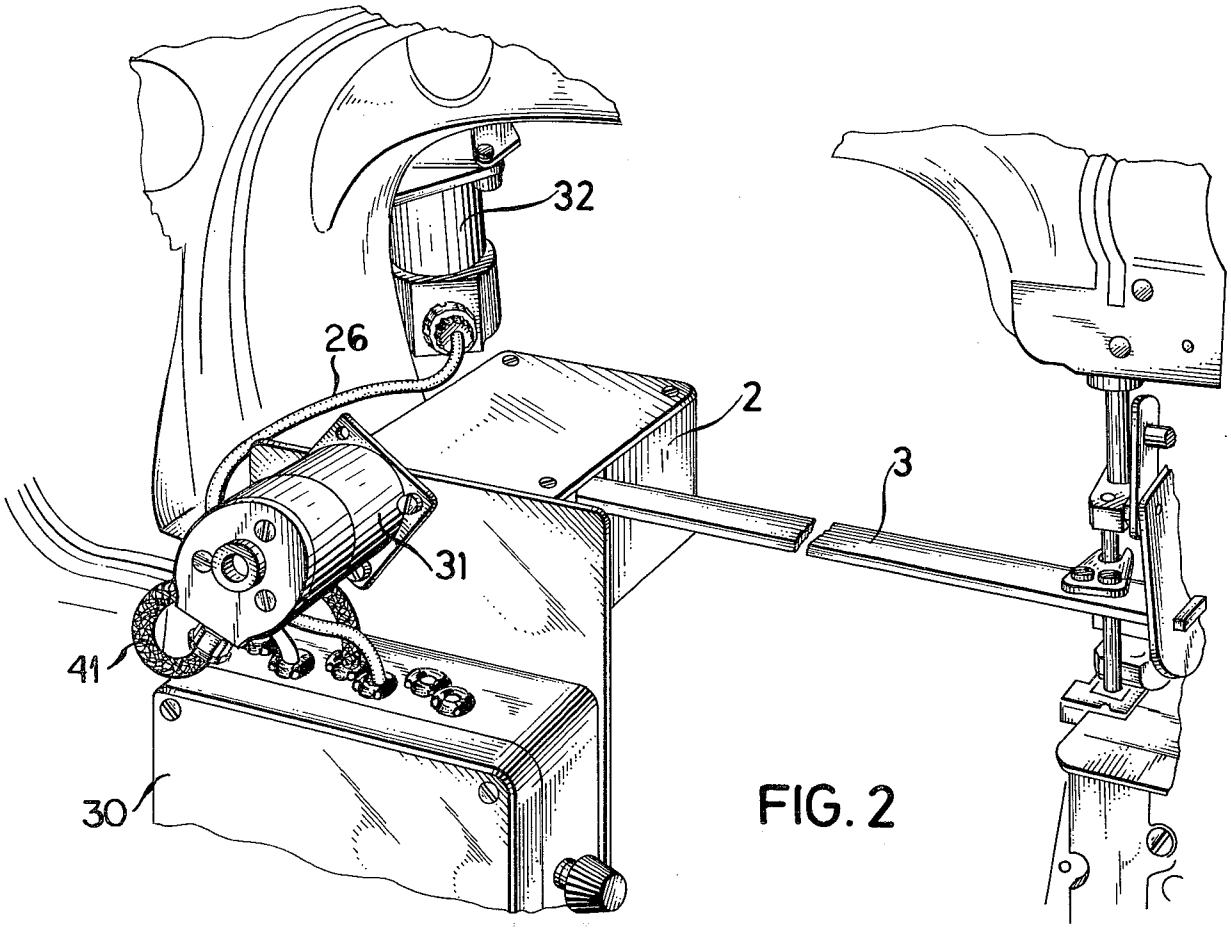
FIG. 2 is a fragmentary perspective side view of the machine.
Figure 3:
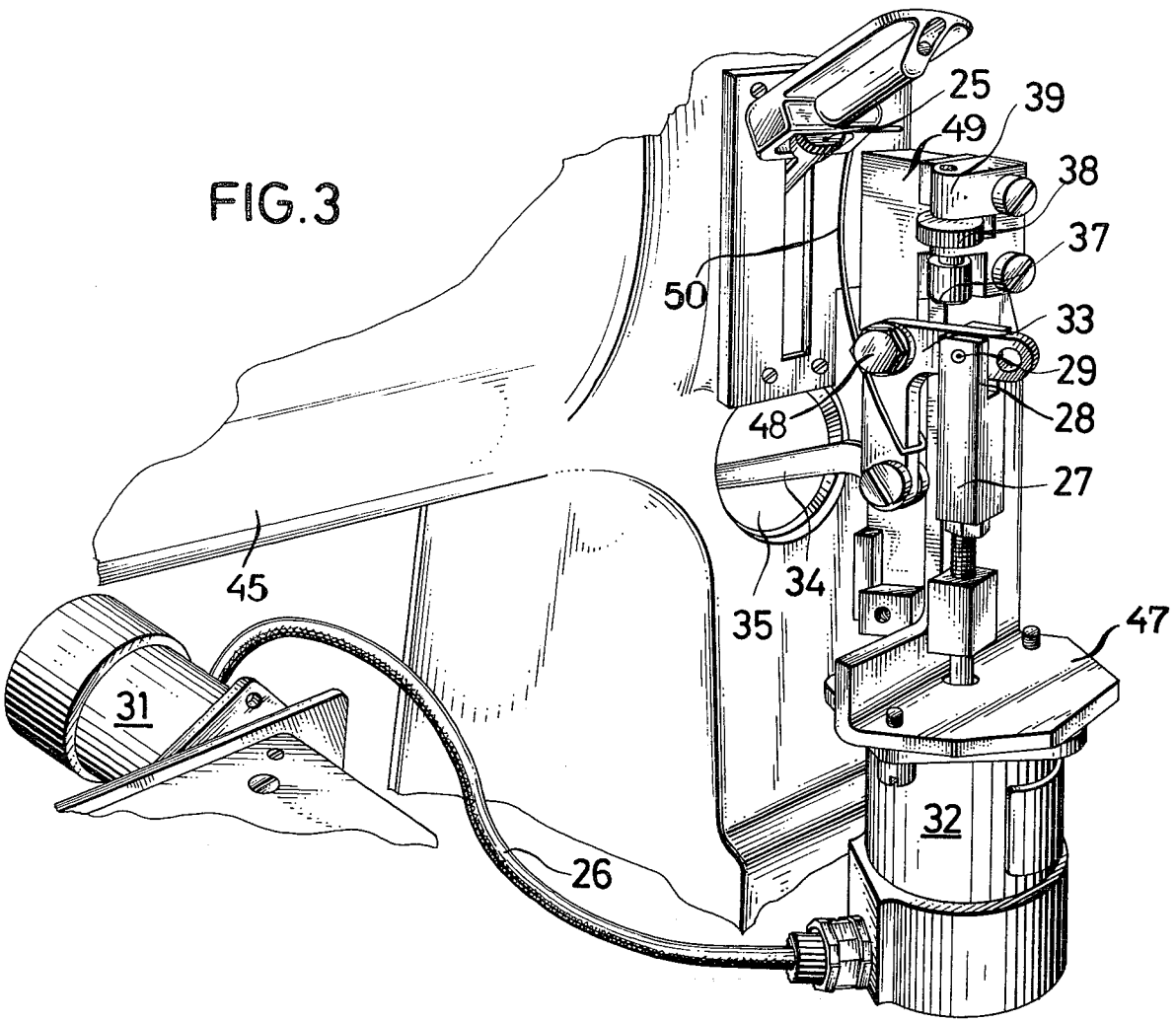
Fig. 3 is a fragmentary perspective end view of the machine pillar with components mounted thereon.

The horizontal swing of looper bar 10 upon its actuation is effected by a link 3, shown in FIG. 2, which is reciprocated by a mechanism not shown inside a casing 2 that includes a rotary cam connected with the machine drive as fully described in the Nicolay patent. A pawl normally held out of contact with that cam is released by a solenoid 31, in response to a command from sensor 14, to bring the looper bar 10 into operative alignment with needle 1 and to reciprocate that bar by way of link 3. When the solenoid is subsequently deenergized, the pawl is again separated from the cam. The aforementioned control unit 30, partly illustrated in FIG. 2, is connected by a cable 41 to solenoid 31 and by another cable 26 to a similar solenoid 32 also shown in FIG. 3. The latter Figure shows the pillar of machine frame 45 provided with a mounting plate 47 to which solenoid 32 is attached, the armature of this solenoid terminating in an arm 27 with a bifurcation 28 straddling a bell-crank lever 33 which is coupled thereto (with the necessary play) by a pin 29 and is swingable about a pivot 48 on a mounting plate 49. The swing of lever 33 is limited by a stop 37 at the lower end of a threaded bolt which is nonrotatably guided in a bracket 39 and can be vertically adjusted by a milled wheel 38. The free end of lever 33, which is biased by a spring 50 into its illustrated position spaced from stop 37, is articulated to a rod 34 passing through an aperture 35 in frame 45 and controlling a device 36 (FIG. 4) for varying the relative stroke lengths of feeders 5 and 23, preferably by acting upon the swing of foot 5. This device should be so designed, as described in German Pat. No. 975,242, that the two feeder strokes are identical in the illustrated position of lever 33 but differ to an extent determined by the stop 37 when the lever is pressed against that stop by the energized solenoid 32. A handle 25 also shown in FIG. 3 serves for a manual adjustment of the basic stroke length.

Figure 4:
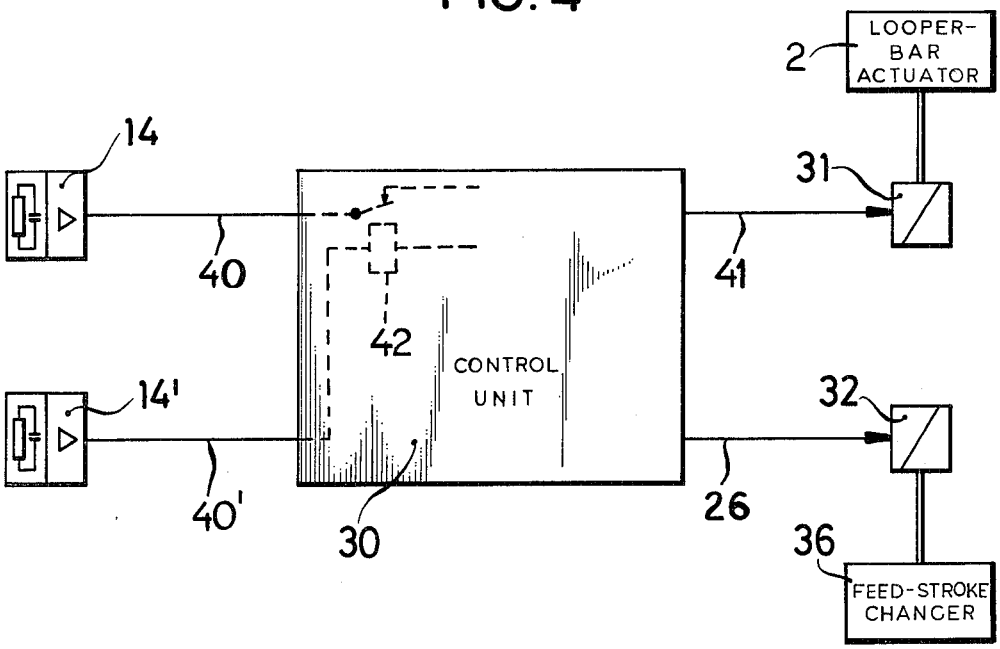
FIG. 4 is a block diagram of an operating circuit for the attachment.

FIG. 4 schematically shows the control unit 30 as including a relay 42 having a break contact in series with sensor 14 so as to open its operating circuit when sensor 14' detects a rise of feed dog 23 beyond the surface of stitch plate 46 as described above. Such a rise, occurring in a predetermined phase of an operating cycle of the machine, could also be detected by a scanning of some other part of its drive. The juxtaposition of sensor 14' with lever 19, however, is particularly advantageous since that lever is readily accessible upon removal of the cover of the machine frame.

The control unit 30 further includes suitable circuitry designed to recognize two distinct commands from sensor 14 in the released state of relay 42. The first command, i.e. a switchover to a different output voltage, is emitted when that sensor detects a rise of lug 7 (FIG. 1) to a level indicating the presence, say, of a shoulder pad between two fabric layers below presser foot 6. The second command, indicating the presence of additional material when a sleeve is to be stitched to an armhole, will be a return to the earlier output voltage when the lug has risen beyond that level. The first command energizes the solenoid 31 to cut in the looper-bar actuator 2; the second command additionally energizes the solenoid 32 to actuate the feed-stroke changer 36 for the purpose described.

Naturally, the single sensor 14 could be replaced by two separate sensors detecting different levels of lug 7 respectively associated with the presence of padding and with the need for the accumulation of excess material. By the same token, such sensors could also be used for performing other switching operations in response to a critical change in the position of the presser foot. My present improvement, therefore, applies generally to any ancillary sewing-machine equipment that is to be activated in the presence of a workpiece portion exceeding a predetermined thickness.

I claim:

1. In a sewing machine provided with a frame and a stitch plate, a bottom feeder below a workpiece-supporting surface of said stitch plate intermittently rising through a slot thereof to advance a workpiece resting thereon, a needle bar vertically oscillatable on said frame in synchronism with said bottom feeder for stitching said workpiece, drive means for operating said bottom feeder and said needle bar, a presser foot with a stem vertically slidable in said frame and spring-urged from above against said workpiece during operation of said drive means, and control means for activating ancillary equipment in the presence of a workpiece below said presser foot exceeding a predetermined thickness, the improvement wherein said control means comprises:

position-sensing means coacting with said presser foot for continuously monitoring the thickness of a workpiece entrained by said bottom feeder;

switching means responsive to a signal from said position-scanning means for activating said ancillary equipment upon detection of a rise of said presser foot to a predetermined level above said surface; and inhibiting means responsive to said drive means for deactivating said position-sensing means whenever said bottom feeder projects above said surface.

2. The improvement defined in claim 1 wherein said ancillary equipment includes a looper bar horizontally oscilatable between said workpiece and a needle carried on said needle bar, to enable the formation of loose stitches through an elastic workpiece portion compacted by said presser foot, said switching means comprising a coupler operable by said position-sensing means to connect said looper bar with said drive means.

3. The improvement defined in claim 2 wherein said position-sensing means comprises a first motion detector on said frame juxtaposed with said stem, said inhibiting means comprising a second motion detector on said frame coacting with a member entrained by said drive means.

4. The improvement defined in claim 3 wherein said member is a link coupled with said needle bar.

5. The improvement defined in claim 3 or 4 wherein said motion detectors are electromagnetic proximity sensors.

6. The improvement defined in claim 1, 2, 3 or 4 wherein said bottom feeder is overlain by a top feeder carried on said frame above said surface and coupled with said drive means for executing workpiece-advancing strokes synchronized with those of said bottom feeder, said ancillary equipment comprising stroke-adjusting means for at least one of said feeders enabling the advance of a top layer and a bottom layer of a two-layer workpiece at different rates.

* * * * *